US008289009B1

(12) United States Patent
Strik et al.

(10) Patent No.: US 8,289,009 B1
(45) Date of Patent: Oct. 16, 2012

(54) LOW DROPOUT (LDO) REGULATOR WITH ULTRA-LOW QUIESCENT CURRENT

(75) Inventors: Viktor Strik, Tallinn (EE); Sergei Strik, Tallinn (EE)

(73) Assignee: Texas Instruments Incorporated, Dallas, TX (US)

( * ) Notice: Subject to any disclaimer, the term of this patent is extended or adjusted under 35 U.S.C. 154(b) by 298 days.

(21) Appl. No.: 12/590,477

(22) Filed: Nov. 9, 2009

(51) Int. Cl.
*G05F 1/618* (2006.01)

(52) U.S. Cl. ..... 323/272; 323/280

(58) Field of Classification Search ..... 323/280–288, 323/272–274, 279; 327/311, 531, 532, 538; 330/303
See application file for complete search history.

(56) References Cited

U.S. PATENT DOCUMENTS 5,889,393 A * 3/1999 Wrathall ..... 323/282
5,939,867 A * 8/1999 Capici et al. ..... 323/277
6,380,721 B2 * 4/2002 Pattamatta et al. ..... 323/269
6,806,690 B2 10/2004 Xi
7,215,103 B1 5/2007 Wong et al.
7,397,226 B1 * 7/2008 Mannama et al. ..... 323/273
7,535,208 B2 * 5/2009 De Cremoux ..... 323/280
7,919,954 B1 * 4/2011 Mannama et al. ..... 323/272
* cited by examiner

*Primary Examiner* — Rajnikant Patel
(74) *Attorney, Agent, or Firm* — Alan A. R. Cooper; Wade James Brady, III; Frederick J. Telecky, Jr.

(57) ABSTRACT

An apparatus includes at least one filter configured to filter a reference voltage to generate a filtered reference voltage. The apparatus also includes an amplifier configured to amplify a difference between the filtered reference voltage and a feedback voltage to generate a drive signal. The apparatus further includes a first transistor configured to generate an output voltage based on the drive signal, where the feedback voltage is based on the output voltage. The apparatus also includes a second transistor configured to generate a first bias current for the amplifier based on the drive signal. In addition, the apparatus includes a voltage-to-current converter configured to generate a second bias current for the amplifier based on the reference voltage and the feedback voltage. The second transistor can generate higher first bias currents during higher load currents, and the voltage-to-current converter can generate higher second bias currents during faster load current variations.

18 Claims, 4 Drawing Sheets

LOW DROPOUT (LDO) REGULATOR WITH ULTRA-LOW QUIESCENT CURRENT

TECHNICAL FIELD

This disclosure is generally directed to voltage regulation. More specifically, this disclosure is directed to a low dropout (LDO) regulator with an ultra-low quiescent current.

BACKGROUND

Low dropout (LDO) regulators are widely used in many types of devices, such as portable electronic devices like mobile telephones, notebook computers, and personal digital assistants. The design of an LDO regulator has become more challenging due to the need to reduce power consumption while still enabling accurate operation of a device. An LDO regulator with a low quiescent current is often desired in a battery-operated electronic device because it can increase the time between battery recharges or replacements. However, small quiescent current consumption can negatively impact other parameters of the LDO regulator, such as its load transient behavior, its power supply rejection ratio (PSRR), and its output voltage noise.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 6, discussed below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1:
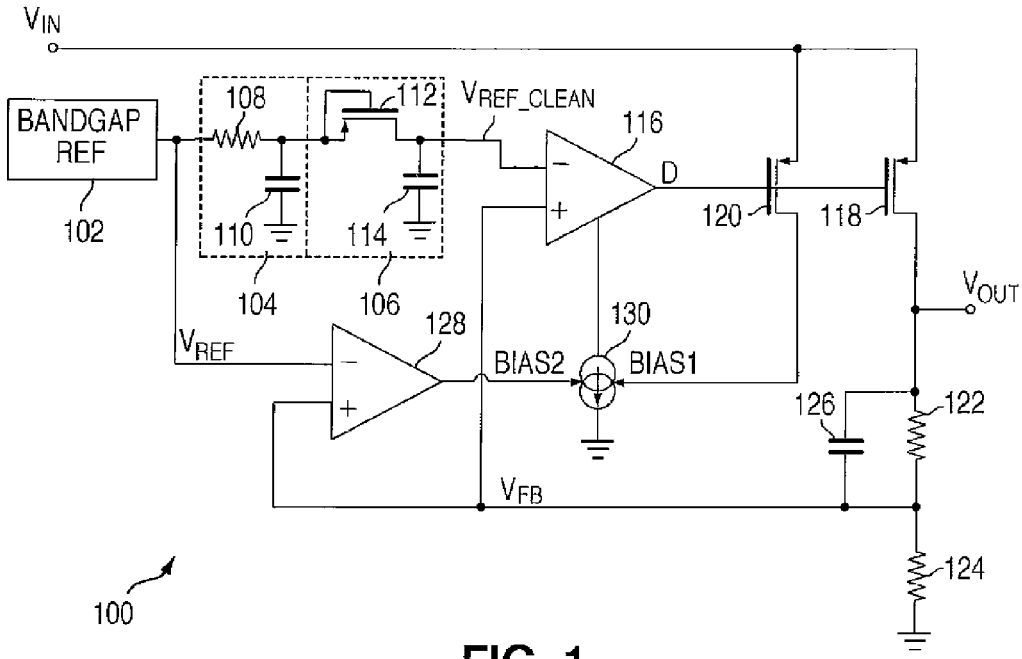
FIG. 1 illustrates an example low dropout (LDO) regulator with an ultra-low quiescent current according to this disclosure.

FIG. 1 illustrates an example low dropout (LDO) regulator 100 with an ultra-low quiescent current according to this disclosure. As shown in FIG. 1, the LDO regulator 100 receives an input voltage $V_{IN}$ and generates a regulated output voltage $V_{OUT}$. In this example, the LDO regulator 100 includes a bandgap voltage reference circuit 102, which generates a relatively stable reference voltage $V_{REF}$. The reference voltage $V_{REF}$ could have any suitable value, such as approximately 1.25V. The bandgap voltage reference circuit 102 includes any suitable structure for generating a reference voltage. The bandgap voltage reference circuit 102 could, for example, represent a low quiescent current bandgap circuit.

The reference voltage $V_{REF}$ in this example is filtered by two filters 104-106. For example, the first filter 104 may remove higher-frequency components from the reference voltage $V_{REF}$, and the second filter 106 may remove lower-frequency noise from the reference voltage $V_{REF}$. In this example, the first filter 104 represents an RC filter formed by a resistor 108 and a capacitor 110. The second filter 104 represents a noise filter formed by a transistor 112 and a capacitor 114. The resistor 108 represents any suitable resistive structure having any suitable resistance. Each of the capacitors 110 and 114 represents any suitable capacitive structure having any suitable capacitance. The transistor 112 includes any suitable transistor device, such as a p-channel metal oxide semiconductor (PMOS) device.

Figure 2A:
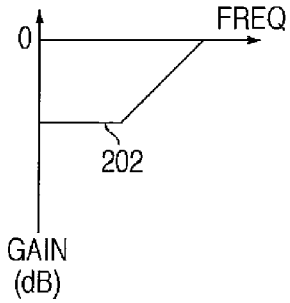
FIGS. 2A through 2C illustrate example waveforms in an LDO regulator with an ultra-low quiescent current according to this disclosure.
Figure 2B:
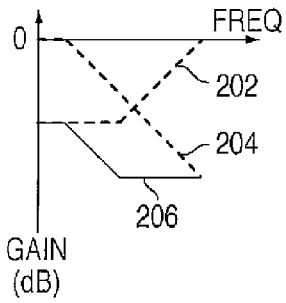

In some embodiments, the bandgap voltage reference circuit 102 may consume a very small amount of quiescent current, such as 550 nA. This would ordinarily lead to a very poor power supply rejection ratio (PSRR) in the LDO regulator 100 as shown in FIG. 2A, where line 202 represents the PSRR characteristics of an example bandgap voltage reference circuit 102 by itself. The presence of the second filter 106 can improve the PSRR of the LDO regulator 100 as shown in FIG. 2B, where line 204 represents the PSRR characteristics of an example filter 106. The combination of the example reference circuit 102 and the example filter 106 has the PSRR characteristics represented by line 206. In particular embodiments, the second filter 106 has a frequency corner of approximately 0.1 Hz. The filter 106 outputs an LDO reference voltage $V_{REF_CLEAN}$.

Figure 2C:
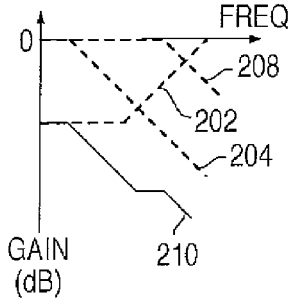

The presence of the first filter 104 can also improve the PSRR of the LDO regulator 100 as shown in FIG. 2C, where line 208 represents the PSRR characteristics of an example filter 104. The combination of the example reference circuit 102 and the example filters 104-106 has the PSRR characteristics represented by line 210. In particular, the first filter 104 could improve PSRR characteristics at higher frequencies, such as in the range of a few kilo-Hertz. The first filter 104 can also reduce the amplitude of possible disturbances at the input of the second filter 106 and help to avoid DC shift of the LDO reference voltage $V_{REF_CLEAN}$.

In particular embodiments, the first filter 104 occupies less area than the second filter 106 since the frequency corner of the first filter 104 can be significantly higher than the frequency corner of the second filter 106. To help reduce the area of the second filter 106, the second filter 106 uses the transistor 112 as a resistor.

The LDO reference voltage $V_{REF_CLEAN}$ is provided to an error amplifier 116, which also receives a feedback voltage $V_{FB}$ that is based on the output voltage $V_{OUT}$. The error amplifier 116 amplifies a difference between the LDO reference voltage $V_{REF_CLEAN}$ and the feedback voltage $V_{FB}$ to generate a drive signal D. The drive signal D is provided to gates of a power transistor 118 and a sense transistor 120. The error amplifier 116 includes any suitable structure for amplifying an error between inputs.

The power transistor 118 receives the input voltage $V_{IN}$. The power transistor 118 is turned on and off by the drive signal D to generate the output voltage $V_{OUT}$. The sense transistor 120 similarly receives the input voltage $V_{IN}$, and the sense transistor 120 is turned on and off by the drive signal D to generate a first bias current BIAS1. The power transistor 118 includes any suitable transistor for generating output voltages, such as a PMOS transistor. The sense transistor 120 includes any suitable transistor for generating a sense signal, such as a smaller PMOS transistor.

A first feedback resistor 122 is coupled to an output terminal where the output voltage $V_{OUT}$ is provided. A second feedback resistor 124 is coupled to the first feedback resistor 122. The feedback resistors 122-124 form a voltage divider that generates the feedback voltage $V_{FB}$. Each of the feedback resistors 122-124 could represent any suitable resistive structure having any suitable resistance. The feedback resistors 122-124 could represent relatively high resistances such as up to 25MΩ or more, where the specific resistances depend on the output voltage $V_{OUT}$. High resistances in the voltage divider can delay fast changes in load variation, which can delay reaction by the error amplifier 116. To help reduce or avoid this problem, an acceleration capacitor 126 is coupled across the resistor 122. The acceleration capacitor 126 represents any suitable capacitive structure having any suitable capacitance.

The reference voltage $V_{REF}$ and the feedback voltage $V_{FB}$ are also provided a transconductance amplifier 128. The transconductance amplifier 128 generates a second bias current BIAS2 based on a difference between its input voltages. In some embodiments, the transconductance amplifier 128 implements a transfer function that is proportional to the absolute value of the difference between the reference voltage $V_{REF}$ and the feedback voltage $V_{FB}$. This can be expressed as:

$$G_m = k|V_{REF} - V_{FB}|$$

where $G_m$ denotes the transconductance of the amplifier 128, and k denotes a gain coefficient of the amplifier 128. The transconductance amplifier 128 includes any suitable structure that generates an output current based on multiple input voltages, such as a voltage-to-current converter.

The bias currents BIAS1 and BIAS2 are provided to a bias current source 130, which generates a third bias current. The third bias current could be very low. The three bias currents can be combined and used to bias the error amplifier 116. The bias current source 130 represents any suitable structure for providing a bias current, such as a 50 nA current source.

As noted above, the LDO regulator 100 achieves good PSRR, good noise characteristics, and good load transient behavior while using an ultra-low quiescent current. In this example, the sense transistor 120 operates to provide a bias current BIAS1 during high load currents. Larger bias currents during this time can help to increase the PSRR of the LDO regulator 100. Also, the load transient behavior of the LDO regulator 100 can be improved using a bias current that is increased during fast load current variations. In FIG. 1, this is achieved using the transconductance amplifier 128, which transforms a voltage drop at the LDO regulator's output during load variations into a bias current BIAS2 that is injected into the input stage of the error amplifier 116. This allows the error amplifier 116 to react more quickly to load current variations and to set the output voltage $V_{OUT}$ at the correct value.

Although FIG. 1 illustrates one example of an LDO regulator 100 with an ultra-low quiescent current, various changes may be made to FIG. 1. For example, the functional division shown in FIG. 1 is for illustration only. Various components in FIG. 1 could be omitted, combined, or further subdivided and additional components could be added according to particular needs. Also, each component in FIG. 1 could be implemented using any suitable structure(s). Further, any suitable filters could be used in the LDO regulator 100. Although FIGS. 2A through 2C illustrate examples of waveforms in an LDO regulator, various changes may be made to FIGS. 2A through 2C. For instance, the bandgap voltage reference circuit 102, first filter 104, and second filter 106 could have any suitable PSRR characteristics.

Figure 3:
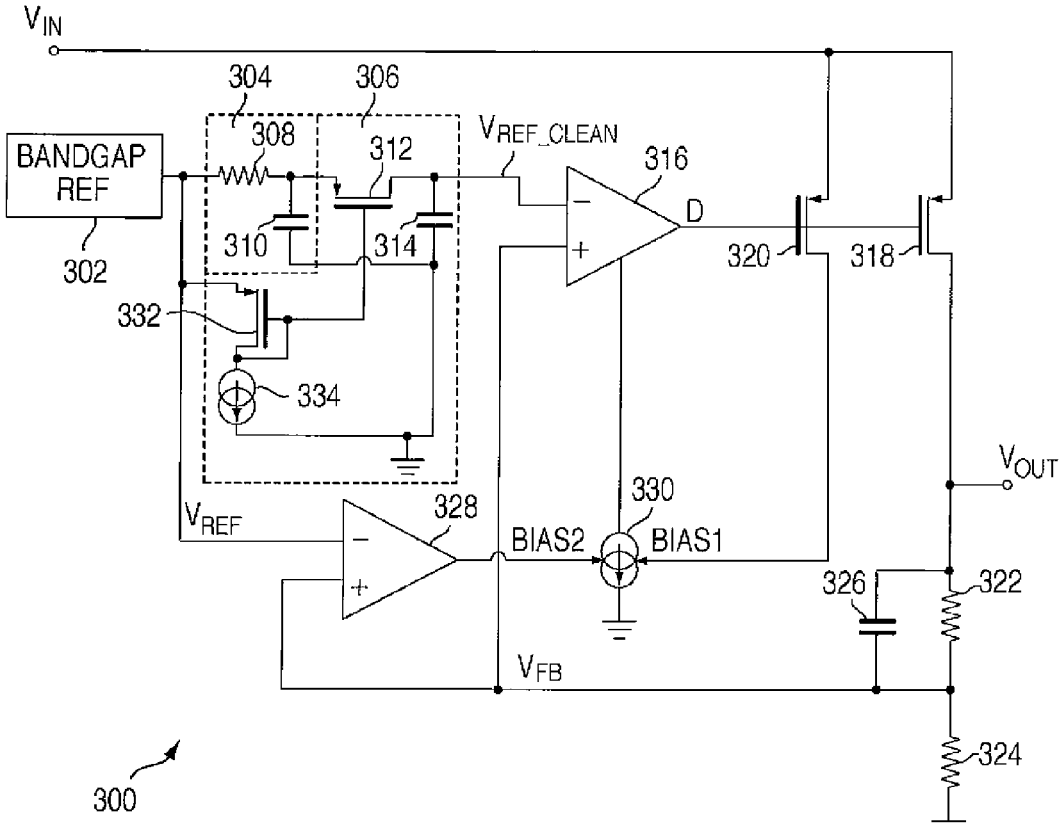
FIG. 3 illustrates another example LDO regulator with an ultra-low quiescent current according to this disclosure.

FIG. 3 illustrates another example LDO regulator 300 with an ultra-low quiescent current according to this disclosure. As shown in FIG. 3, many components 302-330 in the LDO regulator 300 are the same as or similar to the corresponding components 102-130 in the LDO regulator 100 of FIG. 1. In FIG. 3, however, the second filter 306 is different. In particular, the transistor 312 in FIG. 3 does not have its gate connected to the output of the first filter 304.

In FIG. 1, the output voltage $V_{REF_CLEAN}$ from the second filter 106 could shift if there is high-amplitude ripple in the reference voltage $V_{REF}$ generated by the bandgap voltage reference circuit 102. This shift is due to the variable resistivity of the transistor 112. To avoid this situation, the transistor 312 in the LDO regulator 300 of FIG. 3 has its gate coupled to the gate of a transistor 332 and to a current source 334. The transistor 332 receives the reference voltage $V_{REF}$ and is turned on and off by the signal generated between the transistor 332 and the current source 334. The same signal turns the transistor 312 on and off. In this configuration, the resistivity of the transistor 312 may remain generally constant even if high-amplitude ripples exist in the reference voltage $V_{REF}$ generated by the bandgap voltage reference circuit 302. The transistor 332 includes any suitable transistor device, such as a PMOS device. The current source 334 includes any suitable structure for generating current.

Although FIG. 3 illustrates another example of an LDO regulator 300 with an ultra-low quiescent current, various changes may be made to FIG. 3. For example, the functional division shown in FIG. 3 is for illustration only. Various components in FIG. 3 could be omitted, combined, or further subdivided and additional components could be added according to particular needs. Also, each component in FIG. 3 could be implemented using any suitable structure(s). Further, any suitable filters could be used in the LDO regulator 300, including other filters 306 that reduce variation caused by high-amplitude ripple in a reference voltage.

Figure 4:
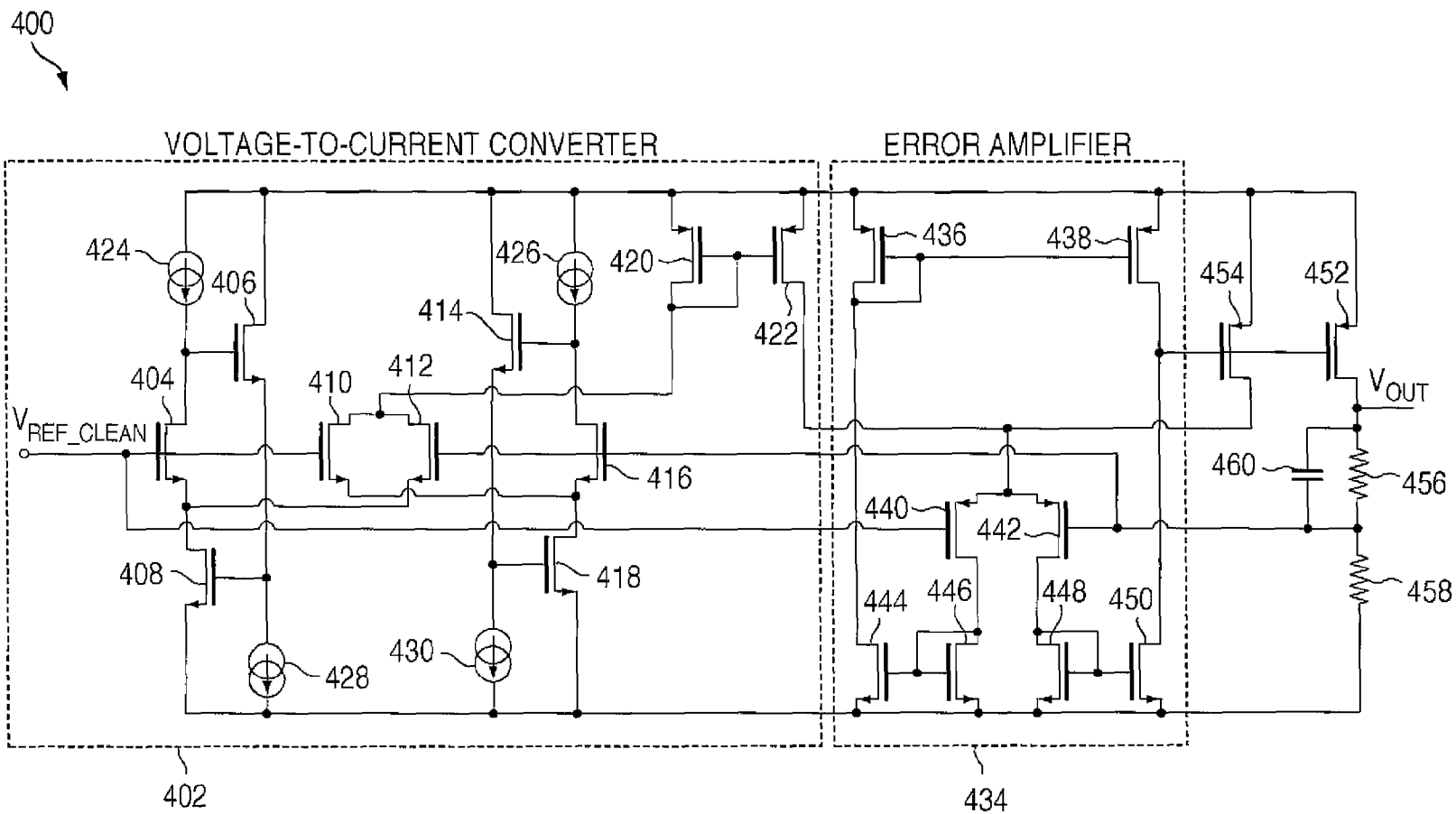
FIG. 4 illustrates a specific implementation of an LDO regulator with an ultra-low quiescent current according to this disclosure.

FIG. 4 illustrates a specific implementation of an LDO regulator 400 with an ultra-low quiescent current according to this disclosure. More specifically, FIG. 4 illustrates one specific implementation of the error amplifier, transconductance amplifier, bias current generator, sense transistor, power transistor, and voltage divider with acceleration capacitor from FIGS. 1 and 3. It is assumed that the circuit in FIG. 4 receives the LDO reference voltage $V_{REF_CLEAN}$ generated by filtering the reference voltage $V_{REF}$.

As shown in FIG. 4, the LDO regulator 400 includes a voltage-to-current converter 402, which could implement the functionality of the transconductance amplifier 128, 328 and the bias current source 130, 330 in FIGS. 1 and 3. In this example, the voltage-to-current converter 402 includes transistors 404-422 and current sources 424-430 arranged as shown in FIG. 4. The LDO regulator 400 also includes an error amplifier 434, which includes transistors 436-450 arranged as shown in FIG. 4. The LDO regulator 400 further includes a power transistor 452, a sense transistor 454, feedback resistors 456-458, and an acceleration capacitor 460.

In this particular example, the transistors 420-422, 436-442, and 452-454 represent PMOS transistors. Also, the transistors 404-418 and 444-450 represent n-channel metal oxide semiconductor (NMOS) transistors.

During a load increase, the output voltage $V_{OUT}$ and the feedback voltage $V_{FB}$ drop. The voltage on the gate of the transistor 414 and the voltage on the gate of the transistor 418 go high, and the current through the transistor 410 increases.

This injects current into the input stage of the error amplifier 434 through a current mirror formed by the transistors 420-422. This allows the error amplifier 434 to restore the output voltage $V_{OUT}$ quickly.

With a load current decrease, the output voltage $V_{OUT}$ and the feedback voltage $V_{FB}$ go higher. This causes the transistor 412 to close the transistor 404. The voltages on the gates of the transistors 406-408 increase, and current through the transistor 412 increases and injects current into the input stage of the error amplifier 434 through the current mirror formed by the transistors 420-422.

Although FIG. 4 illustrates one specific implementation of an LDO regulator 400 with an ultra-low quiescent current, various changes may be made to FIG. 4. For example, the components in an LDO regulator could be formed using any suitable circuitry.

Figure 5:
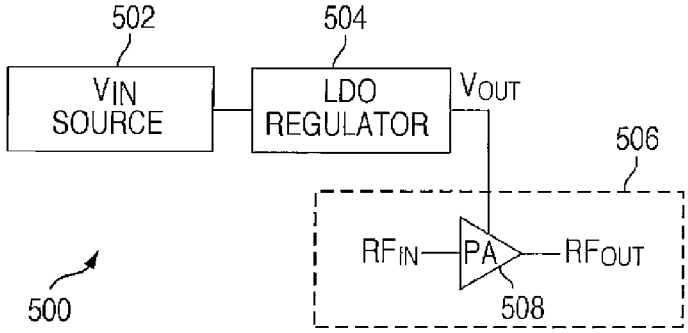
FIG. 5 illustrates an example device having an LDO regulator with an ultra-low quiescent current according to this disclosure.

FIG. 5 illustrates an example device 500 having an LDO regulator with an ultra-low quiescent current according to this disclosure. In this example, the device 500 includes an input voltage source 502 that provides an input voltage $V_{IN}$. The input voltage source 502 represents any suitable source of an input voltage, such as one or more batteries or other voltage sources. The device 500 also includes an LDO regulator 504, which could represent any of the LDO regulators described above. The LDO regulator 504 is coupled to one or more powered components 506, which represent any suitable devices or components that operate using the regulated output voltage $V_{OUT}$ generated by the LDO regulator 504. In this example, the powered components 506 include a power amplifier 508, which is used in wireless mobile devices to amplify a radio frequency input ($RF_{IN}$) or other input signal and generate an amplified radio frequency output ($RF_{OUT}$) or other output signal. The powered components 506 could also include processing circuitry, memory circuitry, display circuitry, or any other or additional types of circuitry or other components that use a regulated output voltage.

Although FIG. 5 illustrates one example of a device 500 having an LDO regulator with an ultra-low quiescent current, various changes may be made to FIG. 5. For example, an LDO regulator with an ultra-low quiescent current could be used in any suitable device or system that uses a regulated output voltage.

Figure 6:
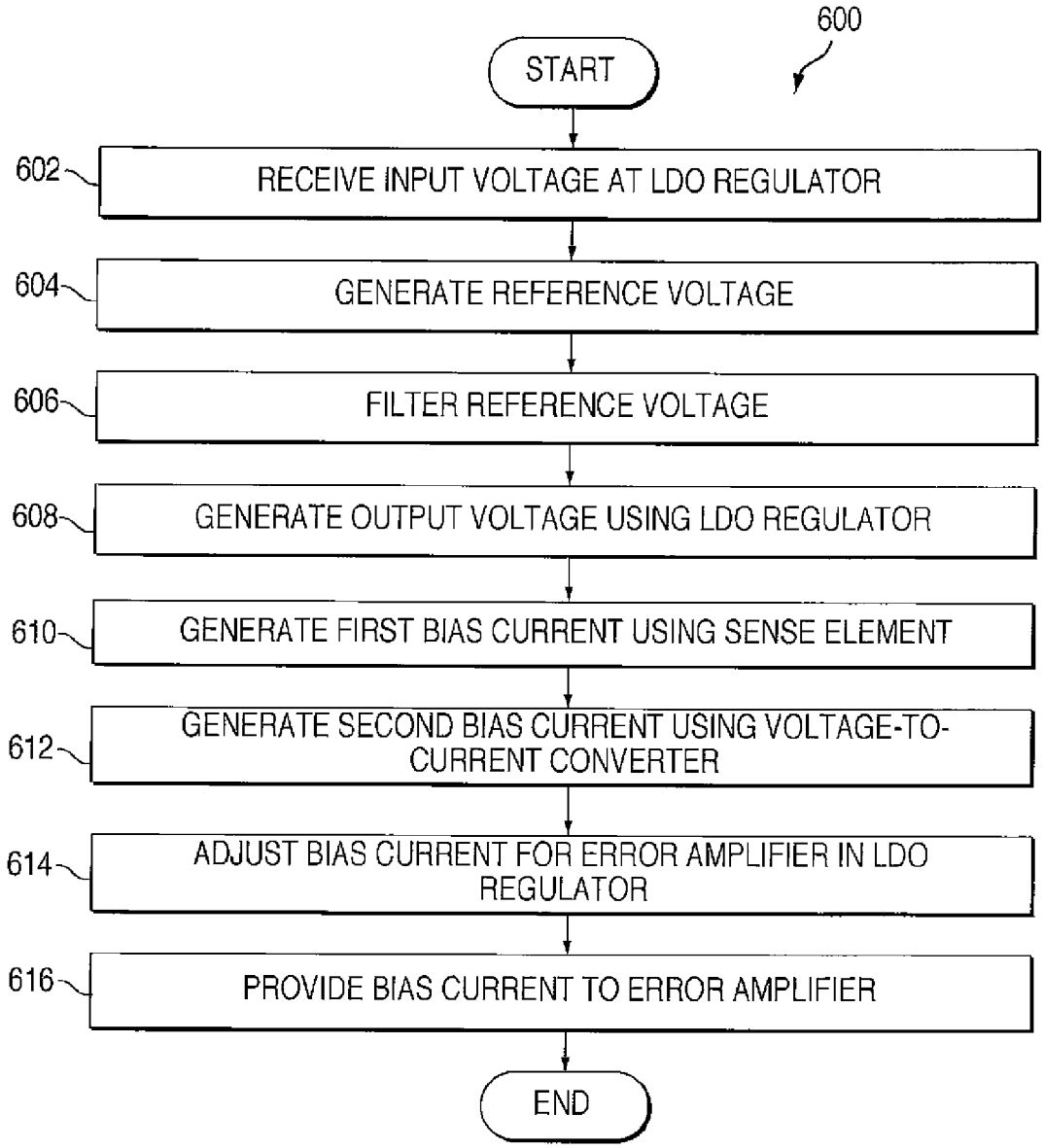
FIG. 6 illustrates an example method for voltage regulation using an ultra-low quiescent current according to this disclosure.

FIG. 6 illustrates an example method 600 for voltage regulation using an ultra-low quiescent current according to this disclosure. As shown in FIG. 6, an LDO regulator receives an input voltage at step 602. This could include, for example, the LDO regulator receiving an input voltage $V_{IN}$ from a battery or other voltage source. The LDO regulator generates a reference voltage at step 604. This could include, for example, a bandgap voltage reference circuit in the LDO regulator generating a reference voltage $V_{REF}$. The reference voltage is filtered at step 606. This could include, for example, the LDO regulator filtering the reference voltage $V_{REF}$ using an RC filter followed by a noise filter to generate an LDO reference voltage $V_{REF_CLEAN}$. The noise filter could include a transistor configured to operate as a resistor. The LDO regulator generates an output voltage at step 608. This could include, for example, the LDO regulator operating a power transistor to generate an output voltage $V_{OUT}$, which can be provided to a load. The output voltage $V_{OUT}$ can be generated using the filtered reference voltage $V_{REF_CLEAN}$.

During generation of the output voltage, the LDO regulator generates a first bias current using a sense element at step 610 and a second bias current using a voltage-to-current converter at step 612. This could include, for example, a sense transistor generating the bias current BIAS1 based on the drive signal D provided to the power transistor. This could also include a transconductance amplifier receiving the reference voltage $V_{REF}$ and a feedback voltage $V_{FB}$ and generating the bias current BIAS2. The bias current for an error amplifier in the LDO regulator is adjusted at step 614. This could include, for example, the LDO regulator combining the bias currents BIAS1 and BIAS2 with a fixed amount of bias current, such as 50 nA. The bias current is provided to the error amplifier at step 616.

In this example, the first bias current generated using the sense element can be used to increase the error amplifier's bias current during high load currents. Also, load transient behavior of the LDO regulator is improved using the second bias current generated by the voltage-to-current converter during fast load current variations. In particular embodiments, the normal bias current for the error amplifier could be 50 nA, although the bias current could increase very rapidly to a higher value, such as 1 μA, based on operation of the sense element and the voltage-to-current converter.

Although FIG. 6 illustrates one example of a method 600 for voltage regulation using an ultra-low quiescent current, various changes may be made to FIG. 6. For example, while shown as a series of steps, various steps in FIG. 6 could overlap, occur in parallel, occur in a different order, or occur multiple times. As a specific example, receipt of the input voltage, generation of the reference voltage, filtering of the reference voltage, and generation of the output voltage can overlap during steps 602-608. As another specific example, steps 610-616 could occur while the input voltage is being received and the output voltage is being generated.

It may be advantageous to set forth definitions of certain words and phrases that have been used within this patent document. The term "couple" and its derivatives refer to any direct or indirect electrical connection between two or more components, whether or not those components are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

at least one filter configured to filter a reference voltage to generate a filtered reference voltage;

an amplifier configured to amplify a difference between the filtered reference voltage and a feedback voltage to generate a drive signal;

a first transistor configured to generate an output voltage based on the drive signal, the feedback voltage based on the output voltage;

a second transistor configured to generate a first bias current for the amplifier based on the drive signal;

a voltage-to-current converter configured to generate a second bias current for the amplifier based on the reference voltage and the feedback voltage; and a bias current source configured to generate a third bias current for the amplifier received in a third input of the amplifier that is not one of a differential pair of inputs, wherein the amplifier is configured to receive a total bias current comprising a combination of the first, second, and third bias currents in the third input of the amplifier that that is not one of a differential pair of inputs of the amplifier.

2. The apparatus of claim 1, wherein the bias current source comprises a 50 nA constant current source.

3. The apparatus of claim 1, further comprising:

a bandgap voltage reference circuit configured to generate the reference voltage.

4. The apparatus of claim 1, wherein the voltage-to-current converter comprises a transconductance amplifier.

5. The apparatus of claim 1, wherein the at least one filter comprises:

a higher-frequency RC filter comprising a first resistor and a first capacitor; and a lower-frequency noise filter comprising a third transistor configured as a second resistor and a second capacitor.

6. The apparatus of claim 5, wherein the noise filter further comprises:

a fourth transistor having a gate coupled to a gate of the third transistor; and a current source coupled to the fourth transistor.

7. The apparatus of claim 1, wherein:

the second transistor is configured to generate higher first bias currents during higher load currents; and the voltage-to-current converter is configured to generate higher second bias currents during faster load current variations.

8. The apparatus of claim 1, further comprising:

a voltage divider configured to generate the feedback voltage, the voltage divider comprising a first feedback resistor and a second feedback resistor coupled to the first feedback resistor; and an acceleration capacitor coupled across the first feedback resistor.

9. A system comprising:

a low dropout (LDO) regulator comprising:

at least one filter configured to filter a reference voltage to generate a filtered reference voltage;

an amplifier configured to amplify a difference between the filtered reference voltage and a feedback voltage to generate a drive signal;

a first transistor configured to generate an output voltage based on the drive signal, the feedback voltage based on the output voltage;

a second transistor configured to generate a first bias current for the amplifier based on the drive signal;

a voltage-to-current converter configured to generate a second bias current for the amplifier based on the reference voltage and the feedback voltage;

a bias current source configured to generate a third bias current for the amplifier received in a third input of the amplifier that is not one of a differential pair of inputs, wherein the amplifier is configured to receive a total bias current comprising a combination of the first, second, and third bias currents in the third input of the amplifier that that is not one of a differential pair of inputs of the amplifier; and a load configured to receive the output voltage.

10. The system of claim 9, further comprising:

an input voltage source configured to provide an input voltage to the first transistor, the first transistor configured to generate the output voltage using the input voltage.

11. The system of claim 9, wherein the LDO regulator further comprises:

a bandgap voltage reference circuit configured to generate the reference voltage.

12. The system of claim 9, wherein the at least one filter comprises:

a higher-frequency RC filter comprising a first resistor and a first capacitor; and a lower-frequency noise filter comprising a third transistor configured as a second resistor and a second capacitor.

13. The system of claim 12, wherein the noise filter further comprises:

a fourth transistor having a gate coupled to a gate of the third transistor; and a current source coupled to the fourth transistor.

14. The system of claim 9, wherein:

the second transistor is configured to generate higher first bias currents during higher load currents; and the voltage-to-current converter is configured to generate higher second bias currents during faster load current variations.

15. A method comprising:

filtering a reference voltage to generate a filtered reference voltage;

amplifying a difference between the filtered reference voltage and a feedback voltage to generate a drive signal using an amplifier;

generating an output voltage based on the drive signal using a first transistor, the feedback voltage based on the output voltage;

generating a first bias current for the amplifier based on the drive signal using a second transistor;

generating a second bias current for the amplifier based on the reference voltage and the feedback voltage; and generating a third bias current for the amplifier received in a third input of the amplifier that is not one of a differential pair of inputs, wherein the amplifier is configured to receive a total bias current comprising a combination of the first, second, and third bias currents in the third input of the amplifier that that is not one of a differential pair of inputs of the amplifier.

16. The method of claim 15, further comprising:

generating a third bias current for the error amplifier using a constant current source, wherein the error amplifier receives a total bias current comprising a combination of the first, second, and third bias currents.

17. The method of claim 15, wherein filtering the reference voltage comprises:

filtering the reference voltage using a higher-frequency RC filter comprising a first resistor and a first capacitor; and filtering an output of the RC filter using a lower-frequency noise filter to generate the filtered reference voltage, the noise filter comprising a third transistor configured as a second resistor and a second capacitor.

18. The method of claim 15, wherein:

the first bias current is higher during higher load currents; and the second bias current is higher during faster load current variations.

* * * * *